US006916768B2

(12) United States Patent
Ward et al.

(10) Patent No.: US 6,916,768 B2
(45) Date of Patent: Jul. 12, 2005

(54) LOW NOISE GREASE GELLING AGENTS

(75) Inventors: Carl E. Ward, San Jose, CA (US); Carlos E. Littlefield, Pinole, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 8 days.

(21) Appl. No.: 10/368,484

(22) Filed: Feb. 20, 2003

(65) Prior Publication Data

US 2004/0167045 A1 Aug. 26, 2004

(51) Int. Cl.[7] ..... C10M 169/02; C10M 115/08
(52) U.S. Cl. ..... 508/522
(58) Field of Search ..... 508/522

(56) References Cited

U.S. PATENT DOCUMENTS

| | | | |
|---|---|---|---|
| 3,243,372 | A | 3/1966 | Dreher et al. |
| 3,870,642 | A | 3/1975 | Gregner |
| 3,920,571 | A | 11/1975 | Crocker |
| 4,436,649 | A | 3/1984 | Stemke |
| 4,661,276 | A | 4/1987 | Stemke |
| 4,668,411 | A | 5/1987 | Yasui et al. |
| 4,759,859 | A | 7/1988 | Waynick |
| 4,780,231 | A | 10/1988 | Kinoshita et al. |
| 5,498,357 | A | 3/1996 | Naka et al. |
| 5,554,586 | A | 9/1996 | Pratt |
| 6,063,743 | A | 5/2000 | Seubert et al. |
| 6,214,778 | B1 | 4/2001 | Todd |
| 6,407,043 | B1 | 6/2002 | Moehr |
| 6,498,130 | B2 | 12/2002 | Baum et al. |

FOREIGN PATENT DOCUMENTS

| | | |
|---|---|---|
| GB | 942519 | 11/1963 |
| JP | 62256892 | 11/1987 |
| JP | 06184577 | 7/1994 |
| WO | WO 02/04579 A1 | 1/2002 |

OTHER PUBLICATIONS

Ward, C.E. et al., "Practical Aspects of Grease Noise Testing", NLGI Spokesman 58:178–182.
Ward, C.E. et al., Chevron SRI Grease NLGI 2 and Chevron SRI Grease Oem NLGI2—A User's Guids (1998).
Netherlands Search Report dated Aug. 16, 2004.
United Kingdom Search Report dated Jan. 28, 2005.

*Primary Examiner*—Jacqueline V. Howard
(74) *Attorney, Agent, or Firm*—Burns, Doane, Swecker & Mathis, L.L.P.

(57) ABSTRACT

The present invention relates to grease gelling agents and greases having low noise characteristics. The greases of the present invention may also exhibit good low shear stability and good heat resistance, as well as the low noise characteristics. The novel grease compositions of the present invention comprise a grease gelling agent comprises a mixture of ≧80 weight percent diureas and 0.1–20 weight percent polyureas.

44 Claims, No Drawings

LOW NOISE GREASE GELLING AGENTS

FIELD OF THE INVENTION

The present invention relates to grease gelling agents and more specifically to grease gelling agents that provide greases exhibiting low noise characteristics.

BACKGROUND OF THE INVENTION

The quiet running properties (noise) of greases used to lubricate deep groove ball bearings have become increasingly important to bearing manufacturers in their selection of factory fill greases. Historically, bearing manufacturers became increasingly concerned about bearing vibration that manifested itself as audible sound as the demand grew for quieter machines. As bearings were machined to finer tolerances, becoming inherently less noisy, the noise contributions of the greases used to lubricate them became increasingly apparent. Consequently, the major bearing manufacturers independently developed instrumentation that allowed measurement of the contribution of grease to bearing noise. In addition, correlation of bearing life to the presence of contaminants promoted an even greater concern with grease noise testing because the assumption is often made that grease noise always correlates to the presence of contaminants and therefore with shortened bearing life. Although most grease manufacturers would agree that knowing the noise characteristics of a grease does not provide sufficient information to allow prediction of the life of a bearing lubricated with it, noise testing is nonetheless increasingly used to assess the overall quality of ball bearing greases. Grease manufacturers therefore must be concerned with the noise quality of their products and with the various methods by which grease noise quality is determined if they are to continue to supply greases to the bearing manufacturing industry.

Although grease noise testing has been the subject of numerous publications over the past twenty-six years, no standard test instrument, test bearing, or test protocol has been adopted by either grease suppliers or bearing manufacturers during this time. In fact, a wide variety of proprietary grease noise testing methods is currently in use, particularly in the bearing manufacturing industry, where each major bearing manufacturer has developed its own proprietary instrumentation and methods. In addition, each method is considered by its proponents to provide a competitive edge for the company that uses it.

Because of the above considerations, testing the quiet running (noise) properties of grease has been an issue. Originally, a manual test was developed which allowed assessment of the running properties of a batch of grease by the feel of a bearing packed with it. As the noise quality of bearings themselves improved, it became necessary to be able to detect lower and lower levels of bearing vibration. As a result, Chevron Research (Richmond, Calif.) began using a modified bearing vibration level tester (an anderometer) to test for grease noise and began carefully studying the effects of additives and processing variables on grease noise. The anderometer, which was originally developed to assess bearing vibrational quality, measures the radial displacement of the outer race of a bearing as a function of its rotation. In fact, the name anderon is an acronym for "angular derivative of the radial displacement". In physical terms, the anderon is expressed as displacement distance/unit rotation:

1 anderon=0.62 microinches/radian.

The sensor head, which is in contact with the outer race, detects bearing vibration. The sensor signals are amplified and filtered into three frequency bands which span the range of audible sound frequencies:

| | |
|---|---|
| Low: | 50–300 Hz |
| Medium: | 300–1,800 Hz |
| High: | 1,800–10,000 Hz. |

Vibration (noise) due to grease can be detected in the medium and high frequency bands. In the earliest version of the Chevron grease noise test, the highest recorded vibrational spike recorded in the medium band during a one-minute run was averaged for five bearings and the average reported as the grease anderon value.

Chevron later refined its test instrument, adding noise pulse counting capability. The pulse counter allows the detection of transients, which are too fast to be recorded on the strip chart recorder. During a test the signal level in each band is displayed on a corresponding meter and is recorded on a strip chart recorder, while the pulse counter detects and displays a figure proportional to the number of vibrational transients that occur above a preset threshold amplitude level. At the end of each test run, the medium band pulse counter reading is noted and the strip chart record of the medium band signal is examined. The first five seconds on the chart are disregarded as start-up noise and the highest amplitude peak (spike) anderon value recorded during the remaining 55 seconds is noted. The noted results for five bearings are averaged and reported as anderon spike value/pulse count.

Chevron further improved its noise testing capability by acquiring the BeQuiet grease noise tester manufactured by SKF Bearing Company. This tester provides additional ability to distinguish subtle differences in noise quality among grease batches. Results are reported in terms of vibrational amplitude in microns/second (similar to anderon value) and in terms of the percentage of measured noise peaks, which fall in to defined noise categories. The noise to categories are designated BQ1, BQ2, BQ3, BQ4, etc. Quieter greases will have a greater percentage of peaks in the lower numbered categories and a lower peak average value.

Different grease compositions have an impact on the amount of bearing vibration and audible noise. Grease noise is attributed to the presence of particles in grease. There are process techniques to help control the particle size during grease manufacture, but these techniques do not improve the low shear stability or heat resistance. In addition to low bearing noise, it is desirable that greases have other properties, including mechanical stability at high and low shear and good heat resistance.

Grease compositions containing a variety of gellant thickeners with urea functional groups have been developed. The polyurea reaction is preferably carried out in situ in the grease carrier, and the reaction product may be utilized directly as a grease.

U.S. Pat. No. 3,243,372 discloses greases thickened with polyureas. In particular, the polyureas have at least four urea groups and hydrocarbon terminal end members.

U.S. Pat. No. 4,436,649 discloses a polyurea-thickened grease containing a polyhydroxylated compound that improves the low shear stability of the grease. The grease composition comprises a major amount of a lubricating oil base vehicle, a polyurea gellant in an amount sufficient to thicken the base vehicle to a grease consistency, and a minor amount of a polyhydroxylated compound.

U.S. Pat. No. 4,661,276 discloses a polyurea-thickened grease containing a polymeric material that improves the low shear stability of the grease. The grease composition comprises a major amount of a lubricating oil base vehicle, a polyurea gellant in an amount sufficient to thicken the base vehicle to a grease consistency, and a minor amount of a polymer having a pKa value greater than 5.0.

U.S. Pat. No. 4,668,411 relates to a diurea type grease composition. The disclosed grease composition comprises a lubricating oil and a thickener, the thickener being a diurea compound prepared by reacting a diisocyanate compound with cyclohexylamine and monoalkylphenylamine wherein the alkyl portion has 8 to 16 carbon atoms.

U.S. Pat. No. 4,780,231 relates to a diurea grease composition containing a lubricant base oil and a thickener. The thickener essentially consists of a mixture of at least two diurea compounds.

U.S. Pat. No. 5,554,586 relates to a grease composition comprising a lubricating oil and a polyurea thickener and a process for its preparation. More specifically, the polyurea thickener is the reaction product of a diisocyanate, a monoamine and a low molecular weight polyoxyalkylene diamine.

U.S. Pat. No. 6,063,743 relates to a lubricating grease composition formed of a basic oil and a lower proportion of a thickening agent which is a polyurea (polycarbamide) compound and the usual additives. These greases were tested and a significant reduction in noise levels was found in comparison with commercially available lubricating grease.

WO 02/04579 relates to a lubricating grease composition having low noise characteristics prepared by shearing a mixture of a base oil and thickener for a time sufficient to reduce substantially all of the thickener to particles below 500 microns in size, and then processing the sheared mixture to a grease. The low noise characteristics are provided by shearing the mixture using a device, such as a static mixer, a mechanical system having counter rotating paddles, cone and stator mills, and roll mills, such that the thickener particles are below 500 microns in size. Therefore, the low noise characteristics are related to the particle size of the thickener.

A common feature of polyurea greases is the way in which they react to shearing (the movement of one lubricant layer with respect to another). At low shear rates, as with simply stirring the grease or working it in a grease worker, the greases tend to soften. In contrast, at high shear rates, as in a rolling element bearing or a grease homogenizer, the greases take on a harder consistency. Generally, this behavior is advantageous for a rolling element bearing grease. However, greases with the tendency to soften under low shear may purge excessively from bearings and cause equipment problems. In order to reduce the extent of low shear softening, grease manufacturers may formulate polyurea greases with the incorporation of a low shear stabilizer.

Relevant literature on the subject of shearing includes Xie Liangsen and Li Hui, Journal of Synthetic Lubrication, Volume 8, No. 1, pages 39–50, which describes the effect of cyclohexyl group on low shear stability. Additional literature references on this subject include C. E. Ward and C. E. Littlefield, NLGI Spokesman, Volume 58, page 178–182 ("Practical Aspects of Grease Noise Testing"); C. E. Ward, "Chevron SRI Grease NLGI 2 and CHEVRON SRI GREASE OEM NLGI 2—A USER'S GUIDE", 1998; "Lubricating Grease Guide", Fourth Edition, National Lubricating Grease Institute, ISBN 0-9613935-1-3, Chapters 2–4; and Lube Tips, Noria newsletter, Mar. 15, 2002.

Heat affects grease in several different ways. When exposed to heat, the grease will soften and it may deteriorate due to oxidation. Also, when exposed to heat, components within the grease may evaporate. When heated, grease generally softens and starts to flow readily. Grease usually will not have a sharp melting point. Grease gradually softens at increasing temperatures until it becomes a flowing liquid. A standard test to measure the heat resistance of a grease is the Dropping Point test. The Dropping Point test approximates the end point of the grease softening process. ASTM (American Society for Testing and Materials) D2265 describes this method. Generally, the higher the grease dropping point, the more heat resistant the grease. In this test grease is packed into a standardized thimble or cup, which has a standard hole at the bottom. Most of the grease is removed with a straight rod. A thermometer is then inserted into the cup, and the cup is placed in a standard assembly in a test tube. In carrying out the test, an aluminum block is preheated to a temperature that depends upon the expected dropping point of the grease sample. The test tube-cup assembly is dropped into a hole in the heated aluminum block, and the cup is watched. At some temperature, a drop comes out of the cup from the hole in the bottom and falls to the bottom of the tube. The sample temperature and the block temperature are read immediately. The dropping point is the sum of the sample temperature and one-third the difference between that temperature and the block temperature. Regardless of the nature of the liquid comprising the drop, its presence defines the dropping point.

There remains a need for greases that consistently have low noise characteristics as well as good low shear stability and good heat resistance.

SUMMARY OF THE INVENTION

Grease gelling agents comprising a mixture of diureas and polyureas, greases containing these gelling agents, and methods for their manufacture, are disclosed.

The present invention relates to a grease gelling agent. The grease gelling agent is comprised of a mixture of ≧80 weight % diureas and 0.1–20 weight % polyureas. The diureas and polyureas are formed by reaction of an alkylamine or alkenylamine; an alkylenediamine, polyoxyalkylenediamine, or cycloalkylenediamine; a cycloalkylamine; and an aryl-containing-diisocyante or alkyldiusocyanate.

In another embodiment, the present invention relates to a grease gelling agent comprising a mixture of diureas of formulas I, II, and III, formula I

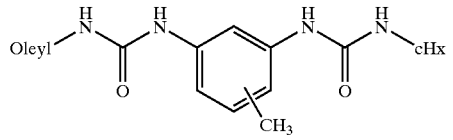

formula II

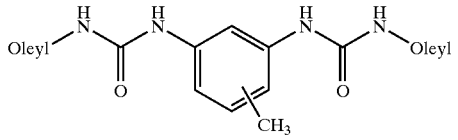

formula III

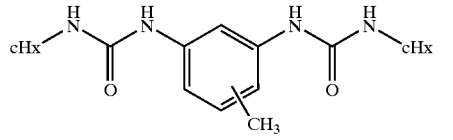

and polyureas of formula IV, formula IV

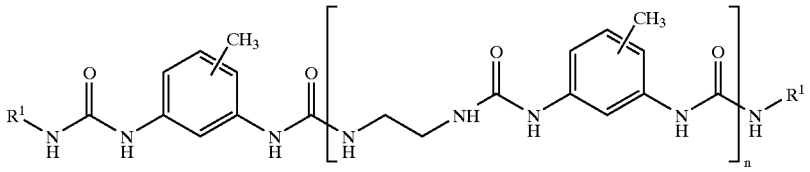

wherein $R^1$ is cHx (cyclohexane) or Olcyl and n is an integer from 1 to 10. The grease gelling agent is comprised of ≧80 weight % of diureas of formulas I, II, and III and 0.1–20 weight % of polyureas of formula IV. Finally, the diureas of formulas I, II, and III are comprised of ≧60 weight % of diurea of formula I, 10–40 weight % of diurea of formula II, and 1–10 weight % of diurea of formula III.

In yet another embodiment, the present invention relates to a grease. The grease is comprised of a lubricant base oil and a grease gelling agent comprising a mixture of ≧80 weight % diureas and 0.1–20 weight % polyureas. The diureas and polyureas are formed by reaction of an alkylamine or alkenylamine; an alkylenediamine, polyoxyalkylenediamine, or cycloalkylenediamine; a cycloalkylamine; and an aryl-containing-diisocyante or alkyldiisocyanate.

In a further embodiment, the present invention relates to a grease comprising a lubricant base oil and a grease gelling agent comprising a mixture of diureas of formulas I, II, and III, formula I

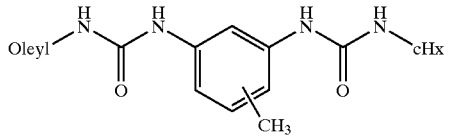

formula II

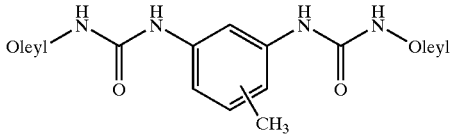

formula III

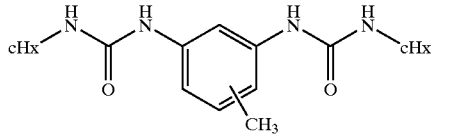

and polyureas of formula IV, formula IV

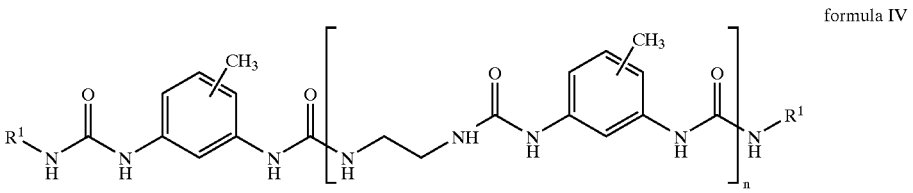

wherein $R^1$ is cHx or Oleyl and n is an integer from 1 to 10. The grease gelling agent is comprised of ≧80 weight % of diureas of formulas I, II, and III and 0.1–20 weight % of polyureas of formula IV. Finally, the diureas of formulas I, II, and III are comprised of ≧60 weight % of diurea of formula I, 10–40 weight % of diurea of formula II, and 1–10 weight % of diurea of formula III.

Finally, the present invention relates to a method for making a grease comprising reacting an alkylamine or alkenylamine; an alkylenediamine, polyoxyalkylenediamine, or cycloalkylenediamine; a cycloalkylamine; and an aryl-containing-diisocyante or alkyldiisocyanate in lubricant base oil and recovering the grease.

DETAILED DESCRIPTION OF THE INVENTION

The present invention relates to greases having low noise characteristics. The greases of the present invention may also exhibit good low shear stability, and good heat resistance, as well as the low noise characteristics.

For purposes of the present invention, the following definitions will be used herein:

"Alkylamine" refers to an amine $NH_2R$ wherein R is a linear saturated monovalent hydrocarbon group of one (1) to thirty five (35) carbon atoms, preferably six (6) to twenty five (25) carbon atoms, or a branched saturated monovalent hydrocarbon radical of three to thirty carbon atoms. Examples of alkylamines include, but are not limited to, pentylamine, hexylamine, heptylamine, octylamine, decylamine, dodecylamine, tetradecylamine, hexadecylamine, octadecylamine and the like.

"Alkenylamine" refers to an amine $NH_2R$ wherein R is a linear unsaturated monovalent hydrocarbon group of two (2) to thirty five (35) carbon atoms, preferably two (2) to twenty five (25) carbon atoms, or a branched unsaturated monovalent hydrocarbon group of three to thirty carbon atoms, wherein the linear unsaturated monovalent hydrocarbon group and the branched unsaturated monovalent hydrocarbon group contains at least one double bond, (—C═C—). Examples of alkenylamines include, but are not limited to, allylamine, 2-butenylamine, 2-propenylamine, 3-pentenylaime, oleylamine, dodeneylamine, hexadecenylamine and the like.

"Alkylenediamine" refers to a diamine $NH_2$—R—$NH_2$ wherein R is a linear saturated divalent hydrocarbon group of one (1) to thirty five (35) carbon atoms, preferably two (2) to twenty five (25) carbon atoms, or a branched saturated divalent hydrocarbon group of three (3) to thirty carbon (35) atoms. Examples of alkylenediamines include, but are not limited to, ethylenediamine, propylenediamine, butylenediamine, hexylenediamine, dodecylenediamine, octylenediamine, and the like.

"Polyoxyalkylenediamine" refers to a diamine $NH_2$—R—$NH_2$ wherein R is a polyoxyalkylene group. A polyoxyalkylene is a divalent repeating ether group of two (2) to thirty five (35) carbon atoms, preferably two (2) to twenty five (25) carbon atoms. Examples of polyoxyalkylenediamines include, but are not limited to, polyoxypropylenediamine, polyoxyethylenediamine, and the like.

"Cycloalkylenediamine" refers to a cycloalkyl group in which two (2) carbon atoms of the cycloalkyl are substituted with an amino group (—$NH_2$). "Cycloalkyl group" refers to a cyclic saturated hydrocarbon group of 3 to 10 ring atoms. Representative examples of cycloalkylenediamine groups include, but are not limited to, cyclopropanediamine, cyclohexanediamine, cyclopentanediamine, and the like.

"Cycloalkylamine" refers to a cycloalkyl group in which one (1) carbon atom of the cycloalkyl is substituted with an amino group (—$NH_2$). "Cycloalkyl group" refers to a cyclic saturated hydrocarbon group of 3 to 10 ring atoms. Representative examples of cycloalkylamine groups include, hut are not limited to, cyclopropylamine, cyclohexylamine, cyclopentylamine, cycloheptylamine, and cyclooctylamine, and the like.

"Aryl-containing diisocyanate" refers to a diisocyanate containing an aryl functionality. "Aryl" refers to a monovalent monocyclic or bicyclic aromatic carbocyclic group of 6 to 14 ring atoms. Examples include, but are not limited to, phenyl, toluenyl, naphthyl, and anthryl. The aryl ring may be optionally fused to a 5-, 6-, or 7-membered monocyclic non-aromatic ring optionally containing 1 or 2 heteroatoms independently selected from oxygen, nitrogen, or sulfur, the remaining ring atoms being carbon where one or two carbon atoms are optionally replaced by a carbonyl. Representative aryl groups with fused rings include, but are not limited to, 2,5-dihydro-benzo[b]oxepine, 2,3-dihydrobenzo[1,4]dioxane, chroman, isochroman, 2,3-dihydrobenzofuran, 1,3-dihydroisobenzofuran, benzo[1,3]dioxole, 1,2,3,4-tetrahydroisoquinoline, 1,2,3,4-tetrahydroquinoline, 2,3-dihydro-1Hindole, 2,3-dihydro1H-isoindle, benzimidazole-2-one, 2-H-benzoxazol-2-one, and the like. The aryl may also be optionally substituted with one to three substituents selected from the group consisting of alkyl, alkenyl, alkynyl, halo, alkoxy, acyloxy, amino, hydroxyl, carboxy, cyano, nitro, and thioalkyl. The aryl ring may be optionally fused to a 5-, 6-, or 7-membered monocyclic non-aromatic ring optionally containing 1 or 2 heteroatoms independently selected from oxygen, nitrogen, or sulfur, the remaining ring atoms being carbon where one or two carbon atoms are optionally replaced by a carbonyl. Examples of aryl-containing diisocyanate include, but are not limited to, toluene diisocyanate, methylenebis(phenylisocyanate), phenylenediisocyanate, bis(diphenylisocyanate), and the like.

"Alkyldiisocyanate" refers to a diisocyanate containing an alkyl functionality. "Alkyl" refers to a linear saturated monovalent hydrocarbon group of one (1) to thirty five (35) carbon atoms, preferably six (6) to twenty five (25) carbon atoms, or a branched saturated monovalent hydrocarbon radical of three to thirty carbon atoms. Examples of alkyldiisocyanates include, but are not limited to, hexanediisocyanate, and the like.

Anderons, recorded in microinches/radian, correspond to the detection of radial displacement of the outer race of a bearing as a function of its rotation. The anderon value is measured using a bearing vibration level tester, or anderometer, such as manufactured by Sugawara Laboratories. In the test, the highest recorded vibrational spike value recorded in the medium band (i.e., 300–1,800 Hz) is recorded during a one-minute run for five bearings. More than one run is performed, and the highest values (i.e., the most noisy events) for each run are averaged and reported as the anderon value.

The designations BQ2 and BQ3 correspond to defined noise categories of the BeQuiet grease noise tester manufactured by SKF Bearing Company. Results of testing using the BeQuiet grease noise tester are reported, in part, in terms of the percentage of measured noise peaks, which fall into the defined noise categories. Specifically, a BQ4 value corresponds to the percentage of measured noise peaks less than or equal to 40 microns/second. A BQ3 value corresponds to the percentage of measured noise peaks less than or equal to 20 microns/second. A BQ2 value corresponds to the percentage of measured noise peaks less than or equal to 10 microns/second. Finally, a BQ1 value corresponds to the percentage of measured noise peaks less than or equal to 5 microns/second.

The abbreviation cHx refers to cyclohexane.

Diisocyanate refers to a compound containing two isocyanate groups, (O═C═N—).

Diurea refers to a compound containing two urea groups,

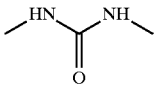

Peak average, recorded in microns/second, corresponds to vibrational amplitude as measured by a SKF Bearing Company BeQuiet grease noise tester. The peak average is the average of the vibrational spike values recorded in the medium band (i.e., 300–1,800 Hz) during a one-minute run for five bearings. The lower the peak average value, the quieter the grease.

Polyurea refers to a compound containing three or more urea groups,

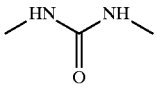

Pulse, recorded in counts, corresponds to the electronic detection of vibrational transients above an empirically determined threshold limit as measured by a bearing vibration level tester, or anderometer, such as manufactured by Sugawara Laboratories. The threshold limit is set using a standard reference grease which is considered to have low noise properties. The pulse counter allows the detection of transients, which are too fast to be recorded on the strip chart recorder. During a test the signal level in each band is displayed on a corresponding meter and is recorded on a strip chart recorder, while the pulse counter detects and displays a figure proportional to the number of vibrational transients that occur above a preset threshold amplitude level. At the end of each test run, the medium band pulse counter reading is noted and the strip chart record of the medium band signal is examined. The first five seconds on the chart are disregarded as start-up noise and the highest amplitude peak (spike) anderon value recorded during the remaining 55 seconds is noted. Results for five bearings are averaged and reported as pulse count.

Low noise characteristics correspond to a peak average value of less than 15 microns/second, preferably less than 12 microns/second, more preferably less than 10 microns/second, and even more preferably less than 5 microns/second, when measured using the BeQuiet grease noise tester manufactured by SKF Bearing Company.

Low noise characteristics may also, and preferably, correspond to additional low noise properties; however, these additional properties are not required for low noise characteristics to be exhibited. Such additional properties include an anderon value of less than 6.0 microinches/radian, preferably less than 4.0 microinches/radian, and most preferably less than 3.5 microinches/radian. Further additional properties include a pulse value of less than 350 counts, preferably less than 300 counts, and most preferably less than 250 counts as measured by an anderometer. Further additional properties also include a percentage of peaks in BQ2 greater than 50%, preferably greater than 70%, and most preferably greater than 90%. Further additional properties include a percentage of peaks in BQ3 of greater than 90%, preferably greater than 95%, and most preferably greater than 98%.

It is also desirable that greases exhibiting low noise characteristics also have other desirable grease properties, including good low shear stability and good heat resistance properties. Good low shear stability corresponds to a positive difference between prolonged worked penetration (Full Scale, P100,000 by ASTM D217) and worked penetration (½ Scale, P60 by ASTM D217) of not larger than 15%, preferably not larger than 10%, and most preferably not larger than 0%. Good heat resistance corresponds to a Dropping Point of at least 215° C., preferably at least 220° C., and most preferably at least 240° C. ASTM D2265 describes the Dropping Point test method.

The term "derived from a Fischer-Tropsch process" or "Fischer-Tropsch derived" means that the product, fraction, or feed originates from or is produced at some stage by a Fischer-Tropsch process.

The present invention relates to grease gelling agents which provide greases exhibiting low noise characteristics, and to greases comprising these grease gelling agents and lubricant base oil. The grease gelling agents of the present invention are formed by reacting a mixture of isocyanates and amines.

Isocyanates and Amines

By combining certain compounds, in particular certain isocyanates and amines, in specific proportions, the grease gelling agents of the present invention are produced.

The compounds to be combined in the present invention are an alkylamine or alkenylamine; an alkylenediamine, polyoxyalkylenediamine, or cycloalkylenediamine; a cycloalkylamine; and an aryl-containing-diisocyante or alkyldiisocyanate. According to the present invention, these compounds are combined to form grease gelling agents. The grease gelling agent may be added to lubricant base oil to provide a grease exhibiting low noise characteristics. In the alternative, these compounds may be combined in a lubricant base oil to provide a grease exhibiting low noise characteristics. Preferably, these compounds are combined in the lubricant base oil to form the grease.

Examples of the alkylamine and alkenylamine to be used in the present invention include, but are not limited to, pentylamine, hexylamine, heptylamine, octylamine, decylamine, dodecylamine, tetradecylamine, hexadecylamine, octadecylamine, oleylamine, dodecenylamine, and hexadecenylamine.

Examples of the alkylenediamine, polyoxyalkylenediamine, or cycloalkylenediamine to be used in the present invention include, but are not limited to, ethylenediamine, propylenediamine, butylenediamine, hexylenediamine, dodecylenediamine, octylenediamine, polyoxypropylenediamine, and cyclohexanediamine.

Examples of the cycloalkylamine to be used in the present invention include, but are not limited to, cyclopentylamine, cycloheptylamine, and cyclooctylamine.

Examples of the aryl-containing-diisocyante or alkyldiisocyanate to be used in the present invention include, but are not limited to, hexanediisocyanate, methylenebis (phenylisocyanate), phenylenediisocyanate, and bis (diphenylisocyanate).

In one specific embodiment, the compounds to be combined in the present invention are toluene diisocyanate (approximately 80% 2,4 isomer and 20% 2,6 isomer) (1), oleylamine (9-octadecen-1-amine) (2), ethylenediamine (3), and cyclohexylamine (4).

Toluene diisocyanate (1) (CAS Number: 26471-62-5) is commercially available from vendors such as Bayer (Pittsburgh, Pa.) and Dow Chemical (Midland, Mich.). Toluene diisocyanate is used in such industries as adhesives coatings manufacturing, elastomer manufacturing, and flexible and rigid foam manufacturing, and is used in solvent-thinned interior clear finishes and synthetic resin and rubber adhesives. The following is the structure of toluene diisocyanate (1):

1

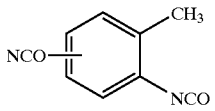

In the present invention the toluene diisocyanate may be a mixture of isomers. Preferably, the mixture will be comprised of approximately 80% 2,4 isomer and 20% 2,6 isomer.

Oleylamine (2) (CAS Number: 112-90-3) is commercially available from vendors such as Akzo-Novel (Chicago, Ill.). Oleylamine can be used as a corrosion inhibitor, and is used in aerosol hairspray. The following is the structure of oleylamine (9-octadecen-1-amine) (2):

2

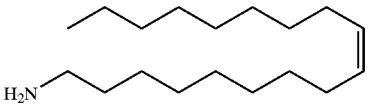

Ethylenediamine (3) (CAS Number: 107-15-3) is commercially available from vendors such as Dow Chemical (Midland, Mich.). Ethylenediamine is used in such industries as printed circuit board manufacturing, can be used as a corrosion inhibitor, an intermediate flux in welding or soldering, a complexing agent, or a process regulator for polyalkene glycols and polyether polyols, and is used in paint and varnish removers. The following is the structure of ethylenediamine (3):

3

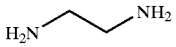

Cyclohexylamine (4) (CAS Number: 108-91-8) is commercially available from vendors such as J. T. Baker (Phillipsburg, N.J.). Cyclohexylamine can be used as a corrosion inhibitor. The following is the structure of cyclohexylamine (4):

4

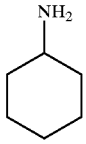

Lubricant Base Oil

The greases exhibiting low noise characteristics of the present invention are comprised of the grease gelling agents of the present invention and lubricant base oil. The lubricant base oil used in the present invention can be selected from Group I, II, III, IV, and V lubricant base oils, and mixtures thereof. The lubricant base oils of the present invention include synthetic lubricant base oils, such as Fischer-Tropsch derived lubricant base oils, and mixtures of lubricant base oils that are not synthetics and synthetics. The specifications for Lubricant Base Oils defined in the API Interchange Guidelines (API Publication 1509) using sulfur content, saturates content, and viscosity index, are shown below in Table I:

TABLE I

| Group | Sulfur, ppm | | Saturates, % | VI |
|---|---|---|---|---|
| I | >300 | And/or | <90 | 80–120 |
| II | ≦300 | And | ≧90 | 80–120 |
| III | ≦300 | And | ≧90 | >120 |
| IV | All Polyalphaolefins | | | |
| V | All Stocks Not Included in Groups I–IV | | | |

Facilities that make Group I lubricant base oils typically use solvents to extract the lower viscosity index (VI) components and increase the VI of the crude to the specifications desired. These solvents are typically phenol or furfural. Solvent extraction gives a product with less than 90% saturates and more than 300 ppm sulfur. The majority of the lubricant production in the world is in the Group I category.

Facilities that make Group II lubricant base oils typically employ hydroprocessing such as hydrocracking or severe hydrotreating to increase the VI of the crude oil to the specification value. The use of hydroprocessing typically increases the saturate content above 90 and reduces the sulfur below 300 ppm. Approximately 10% of the lubricant base oil production in the world is in the Group II category, and about 30% of U.S. production is Group II.

Facilities that make Group III lubricant base oils typically employ wax isomerization technology to make very high VI products. Since the starting feed is waxy vacuum gas oil (VGO) or wax which contains all saturates and little sulfur, the Group III products have saturate contents above 90 and sulfur contents below 300 ppm. Fischer-Tropsch wax is an ideal feed for a wax isomerization process to make Group III lubricant base oils. Only a small fraction of the world's lubricant supply is in the Group III category.

Group IV lubricant base oils are derived by oligomerization of normal alpha olefins and are called poly alpha olefin (PAO) lubricant base oils.

Group V lubricant base oils are all others. This group includes synthetic esters, silicon lubricants, halogenated lubricant base oils and lubricant base oils with VI values below 80. For purposes of this application, Group V lubricant base oils exclude synthetic esters and silicon lubricants. Group V lubricant base oils typically are prepared from petroleum by the same processes used to make Group I and II lubricant base oils, but under less severe conditions.

Synthetic lubricant base oils meet API Interchange Guidelines but are prepared by Fisher-Tropsch synthesis, ethylene oligomerization, normal alpha olefin oligomerization, or oligomerization of olefins boiling below $C_{10}$. For purposes of this application, synthetic lubricant base oils exclude synthetic esters and silicon lubricants.

Forming the Grease Gelling Agents

The grease gelling agents of the present invention, which provide greases exhibiting low noise characteristics, are produced by a reaction that occurs when the above-described compounds are combined. When the compounds alkylamine or alkenylamine; alkylenediamine, polyoxyalkylenediamine, or cycloalkylenediamine; cycloalkylamine; and aryl-containing-diisocyante or alkyl-diisocyanate are combined in specific proportions, a reaction occurs that produces grease gelling agents that provide greases exhibiting low noise characteristics. The grease gelling agents of the present invention comprise a mixture of diureas and polyureas.

The compounds of the present invention may be combined to form a grease gelling agents and then added to lubricant base oil to form a grease exhibiting low noise characteristics. In the alternative, the compounds of the present invention are combined in a lubricant base oil to form a grease exhibiting low noise characteristics. Preferably, the compounds of the present invention are combined in lubricant base oil.

Specifically, the reaction that occurs when toluene diisocyanate (1), oleylamine (2), ethylenediamine (3), and cyclohexylamine (4) are combined to provide grease gelling agents is as follows:

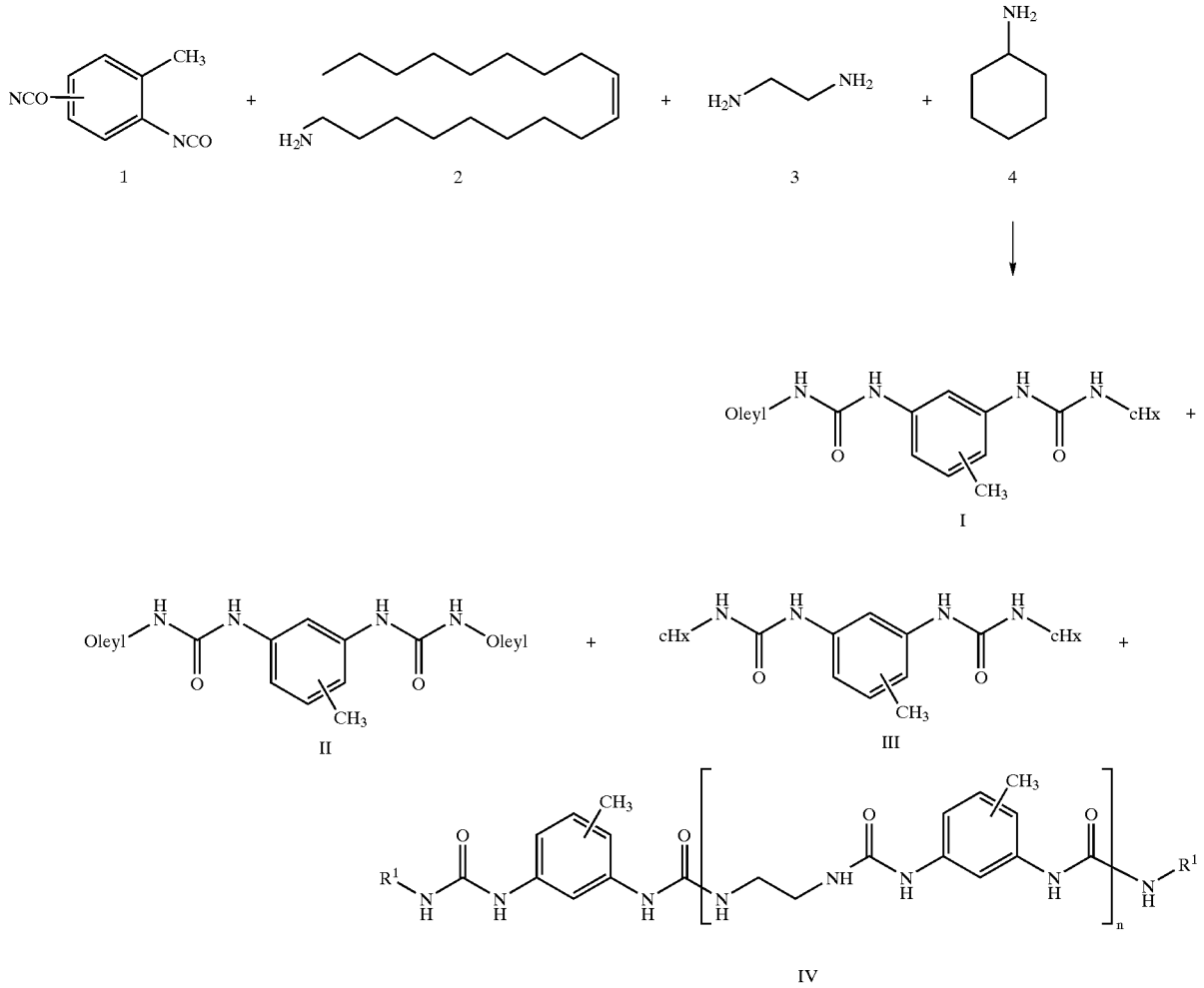

wherein $R^1$ is cHx or Oleyl and n is an integer from 1 to 10.

The grease gelling agents of the present invention formed when toluene diisocyanate (1), oleylamine (2), ethylenediamine (3), and cyclohexylamine (4) are combined are comprised of diurea of formula I, which has a molecular weight of 540, diurea of formula II, which has a molecular weight of 708, diurea of formula III, which has a molecular weight of 372, and polyureas of formula IV. The total content of polyureas of formula IV in the grease gelling agents is ≦20 weight %, preferably ≦10 weight %, more preferably ≦5 weight %, and most preferably 2–3 weight %, while the corresponding total content of diureas of formulas I, II, and III in the grease gelling agents is ≧80 weight %, preferably ≧90 weight %, more preferably ≧95 weight %, and most preferably 97–98 weight %. Furthermore, the total content of diureas of formulas I, II, and III is comprised of ≧60 weight %, preferably 60–80 weight %, and more preferably 66–72 weight %, of diurea of formula I; 10–40 weight %, preferably 20–30 weight %, and more preferably 23–37 weight %, of diurea of formula II; and 1–10 weight %, preferably 1–5 weight %, and most preferably 3–4 weight %, of diurea of formula III.

Accordingly, the above-illustrated reaction results in grease gelling agents comprising diureas of formula I, II, and Ill and polyureas of formula IV. It is the particular combination of all of the urea products that provides the excellent low noise grease characteristics. If only diureas of formula I, II, and III or polyureas of formula IV are present in a grease, the grease properties are less desirable. Accordingly, in one embodiment, the grease gelling agents of the present invention comprise a mixture of diureas of formula I, II, and III and polyureas of formula IV.

Greases

The grease compositions of the present invention comprise a lubricant base oil and the grease gelling agents as described above. The grease compositions comprise the lubricant base oil in an amount of from approximately 99.5 to 75 weight percent and the grease gelling agent in an amount of from approximately 0.5 to 25 weight percent. More preferably, the lubricant base oil in an amount of from approximately 92 to 85 weight percent and the grease gelling agent in an amount of from approximately 8 to 15 weight percent.

The grease compositions of the present invention may also comprise other additives such as antioxidants, corrosion preventative agents, antiwear agents, load carrying additives, Extreme Pressure (EP) additives, antirust agents, tackiness agents, metal deactivators, colorants, and the like.

The grease compositions of the present invention exhibit low noise characteristics. Preferably, the grease compositions of the present invention also exhibit good shear stability and good heat resistance.

Noise

A grease exhibiting low noise characteristics of the present invention exhibits a peak average value of less than 15 microns/second, preferably less than 12 microns/second, more preferably less than 10 microns/second, and even more preferably less than 5 microns/second when tested using a BeQuiet grease noise tester manufactured by SKF Bearing Company. A grease exhibiting low noise characteristics of the present invention may also exhibit one or more of the additional low noise properties as defined above.

Accordingly, a grease exhibiting low noise characteristics of the present invention may have a small anderon value, a small pulse value, a small peak average value, and a large percentage of peaks in the lower numbered (i.e., BQ2 and BQ3) categories, as provided above. The low noise properties in addition to the small peak average value are not required for low noise characteristics to be exhibited. Preferably, a grease of the present invention does exhibit one or more of these additional properties.

It is also desirable that greases exhibiting low noise characteristics also have other desirable grease properties, including good low shear stability and good heat resistance properties.

Shear Stability

Shear stability is the ability of a grease to resist a change in consistency during mechanical working. Under high rates of shear, grease structures tend to change in consistency. Greases with poor low shear stability will quickly break down, resulting in a thinning of the grease. A grease with good low shear stability, therefore, will not soften excessively under prolonged low shear stress.

A large difference between the prolonged worked penetration (Full Scale, P100,000 by ASTM D217) and the worked penetration (½ Scale, P60 by ASTM D1403) of a grease indicates poor low shear stability. Accordingly, it is desired that the greases exhibiting low noise characteristics of the present invention have a positive difference between prolonged worked penetration and worked penetration of not larger than 15%, preferably not larger than 10%, and most preferably not larger than 0%.

Heat Resistance

When grease is heated, it becomes progressively softer until at some point the grease no longer functions as a thickened lubricant. The heat resistance of a grease is often measured by its Dropping Point, such that good heat resistance is associated with a high Dropping point. The Dropping Point test is described in ASTM D2265. Thus, it is desired that the greases of the present invention exhibiting low noise characteristics will have a Dropping Point of at least 215° C., preferably at least 220° C., and most preferably at least 240° C.

The following examples are given to illustrate the invention and should not be construed to limit the scope of the invention.

EXAMPLES

Several different greases were prepared using differing amounts of cyclohexylamine, oleylamine, and ethylenediamine.

The greases were prepared as follows: A large stainless steel mixing bowl (Kitchen-Aid mixer bowl) was charged with 766.2 grams of the base oil (Group I, II, III (including Unconventional Base Oil and Fischer Tropsch derived lubricant base oil) or Group IV (PAO)). The mixer (Kitchen-Aid) was started (moderate rate) and the calculated amounts of the primary monoamines and diamines were added to the oil. The mixture was stirred and heated to 150° F. at which point the calculated amount of diisocyanate was added dropwise to the mixture. After the addition was complete, the thickened mixture was heated to 200° F. for one hour to drive the reaction to completion, (completion of the reaction was monitored by infra-red spectroscopy, specifically, disappearance of the isocyanate absorbance at 2260 cm-1 was monitored). If necessary, the thickener mixture was passed through a 3-roll mill to produce grease having a worked penetration of 265–295 (NLGI 2 grade). Thickener contents of the greases ranged from 11 to 21%, depending upon the identities and proportions of the raw materials used.

Results that demonstrate that the use of cyclohexylamine provides good low shear stability are summarized in Table II.

TABLE II

| Sample ID | C2172-04-01 | C2172-14-01 | C2172-17-01 | C2172-32-01 |
|---|---|---|---|---|
| Mole Ratios | | | | |
| Toluene Diisocyanate | 1 | 1 | 1 | 1 |
| Oleylamine | 1 | 2 | 0.67 | 1.9 |
| Cyclohexylamine | 1 | 0 | 1.33 | 0 |
| Ethylenediamine | 0 | 0 | 0 | 0.1 |
| Worked Penetration (½ Scale, P60) | 273 | 272 | 268 | 268 |
| Prolonged Worked Penetration (Full Scale, P100,000) | 280 | 449 | 285 | 504 |
| Change in Worked Penetration | +7 | +177 | +17 | +236 |

Results that demonstrate that at least a small amount of ethylenediamine is necessary to obtain good heat resistance in combination with low noise are summarized in Table III.

TABLE III

| Sample ID | C2172-14-01 | C2172-04-01 | C2172-34-01 |
|---|---|---|---|
| Mole Ratios | | | |
| Toluene Diisocyanate | 1 | 1 | 1 |
| Oleylamine | 2 | 1 | 0.95 |
| Cyclohexylamine | 0 | 1 | 0.95 |
| Ethylenediamine | 0 | 0 | 0.05 |
| Chevron Noise Test | | | |
| Anderons | 3.24 | 8.04 | 3.2 |
| Pulse | 866 | 7252.4 | 63 |
| Peak Average | 16.0 | 14.8 | 3.1 |
| BeQuiet Noise Test | | | |
| % BQ2 | 73.5 | 49.0 | 97.0 |
| % BQ3 | 19.8 | 80.0 | 99.0 |
| Heat Resistance | | | |
| Dropping Point, ° C. | 185 | 212 | 265 |

Results that demonstrate that simple diurea thickeners alone (with no ethylenediamine) can provide high dropping point and/or good shear stability but not low noise are shown in Table IV.

TABLE IV

| Sample ID | C2172-04-01 | C2172-17-01 | C2172-19-01 | C2172-34-01 |
|---|---|---|---|---|
| Mole Ratios | | | | |
| Toluene Diisocyanate | 1 | 1 | 1 | 1 |
| Oleylamine | 1 | 0.67 | 0.45 | 0.95 |
| Cyclohexylamine | 1 | 1.33 | 1.55 | 0.95 |
| Ethylenediamine | 0 | 0 | 0 | 0.05 |
| Heat Resistance | | | | |
| Dropping Point, ° C., | 212 | 219 | 236 | 265 |
| Shear Stability | | | | |
| Worked Penetration (½ Scale, P60) | 273 | 268 | 273 | 272 |
| Prolonged Worked Penetration (Full Scale, P100,000) | 280 | 285 | 325 | 251 |
| Change in Worked Penetration | +7 | +17 | +52 | −21 |
| Chevron Noise Test | | | | |
| Anderons | 8.04 | 5.82 | >10 | 3.2 |
| Pulse | 7252.4 | 2765 | 37,701 | 63 |
| Peak Average | 14.8 | 18.6 | 49.5 | 3.1 |
| BeQuiet Noise Test | | | | |
| % BQ2 | 49.0 | 46.0 | 7.0 | 97.0 |
| % BQ3 | 80.0 | 62.0 | 14.0 | 99.0 |

Table V below shows that a reasonable low noise grease can be made using Fischer Tropsch derived lubricant base oil (FT) in comparison to a Unconventional base oil (UCB) and a PAO.

TABLE V

| Example Number | % Thickener | Base Fluid | Worked Penetration | Noise, SKF-BeQuiet Peak Average (microns/sec) | % BQ 2 | % BQ 3 |
|---|---|---|---|---|---|---|
| 1 | 13.2 | 8 cSt FT | 294 | 11.7 | 74 | 93 |
| 2 | 13.2 | 7 cSt UCB | 293 | 6.2 | 91 | 100 |
| 3 | 13.2 | 8 cSt PAO | 286 | 2.7 | 98 | 100 |

Various modifications and alterations of this invention will become apparent to those skilled in the art without departing from the scope and spirit of this invention. Other objects and advantages will become apparent to those skilled in the art from a review of the preceding description.

What is claimed is:

1. A grease gelling agent comprising a mixture of ≧80 weight % diureas and 0.1–20 weight % polyureas, wherein the diureas and polyureas are formed by reaction of (a) an alkylamine or alkenylamine; (b) an alkylenediamine, polyoxyalkylenediamine, or cycloalkylenediamine; (c) a cycloalkylamine; and (d) an aryl-containing-diisocyante or alkyldiisocyanate.

2. The grease gelling agent of claim 1, wherein the alkylamine or alkenylamine is selected from the group consisting of oleylamine, pentylamine, hexylamine, heptylamine, octylamine, decylamine, dodecylamine, tetradecylamine, hexadecylamine, octadecylamine, docecenylamine, hexadecenylamine, and mixtures thereof.

3. The grease gelling agent of claim 1, wherein the alkylenediamine, polyoxyalkylenediamine, or cycloalkylenediamine is selected from the group consisting of ethylene, propylenediamine, butylenediamine, hexylenediamine, dodecylenediamine, octylenediamine, polyoxypropylenediamine, cyclohexanediamine, and mixtures thereof.

4. The grease gelling agent of claim 1, wherein the cycloalkylamine is selected from the group consisting of cyclohexylamine, cyclopentylamine, cycloheptylamine, and cyclooctylamine.

5. The grease gelling agent of claim 1, wherein the aryl-containing-diisocyante or alkyldiusocyanate is selected from the group consisting of toluene diisocyanate, hexanediisoycanate, methylene bis(phenylisocyanate), phenylenediisocyanate, bis(diphenylisocyanate), and mixtures thereof.

6. The grease gelling agent of claim 1, wherein the diureas and polyureas are formed by the reaction of oleylamine, ethylenediamine, cyclohexylamine, and tolune diisocyanate.

7. A grease gelling agent comprising a mixture of diureas of formulas I, II, and III, formula I

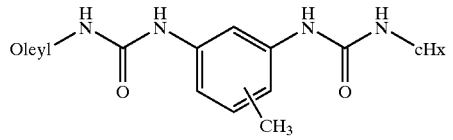

formula II

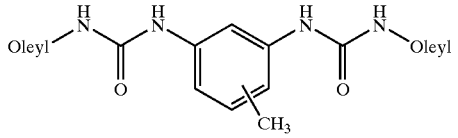

formula III

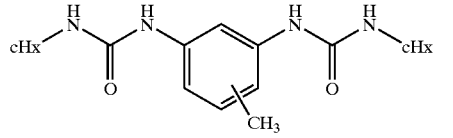

and polyureas of formula IV, formula IV

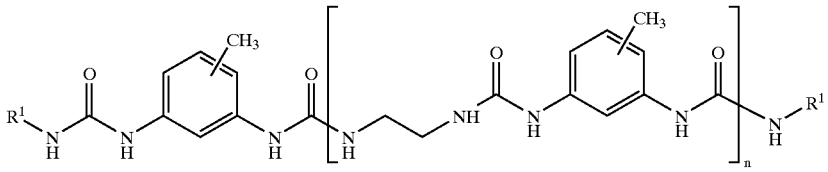

wherein:

$R^1$ is cHx or Oleyl; and n is an integer from 1 to 10;

wherein:

the grease gelling agent is comprised of ≧80 weight % of diureas of formulas I, II, and III and 0.1–20 weight % of polyureas of formula IV; and the diureas of formulas I, II, and III are comprised of ≧60 weight % of diurea of formula I, 10–40 weight % of diurea of formula II, and 1–10 weight % of diurea of formula III.

8. The grease gelling agent of claim 7, wherein the grease gelling agent is comprised of ≧90 weight % of diureas of formulas I, II, and III and 0.1–10 weight % of polyureas of formula IV.

9. The grease gelling agent of claim 8, wherein the grease gelling agent is comprised of ≧95 weight % of diureas of formulas I, II, and III and 0.1–5 weight % of polyureas of formula IV.

10. The grease gelling agent of claim 8, wherein the diureas of formulas I, II, and III are comprised of 60–80 weight % of diurea of formula I, 20–30 weight % of diurea of formula II, and 1–5 weight % of diurea of formula III.

11. The grease gelling agent of claim 9, wherein the diureas of formulas I, II, and III are comprised of 60–80 weight % of diurea of formula I, 20–30 weight % of diurea of formula II, and 1–5 weight % of diurea of formula III.

12. A grease comprising a lubricant base oil and a grease gelling agent comprising a mixture of ≧80 weight % diureas and 0.1–20 weight % polyureas, wherein the diureas and polyureas are formed by reaction of (a) an alkylamine or alkenylamine; (b) an alkylenediamine, polyoxyalkylenediamine, or cycloalkylenediamine; (c) a cycloalkylamine; and (d) an aryl-containing-diisocyante or alkyldiisocyanate.

13. The grease of claim 12, wherein the alkylamine or alkenylamine is selected from the group consisting of oleylamine, pentylamine, hexylamine, heptylamine, octylamine, decylamine, dodecylamine, tetradecylamine, hexadecylamine, octadecylamine, docecenylamine, hexadecenylamine, and mixtures thereof.

14. The grease of claim 12, wherein the alkylenediamine, polyoxyalkylenediamine, or cycloalkylenediamine is selected from the group consisting of ethylenediamine, propylenediamine, butylenediamine, hexylenediamine, dodecylenediamine, octylenediamine, polyoxypropylenediamine, cyclohexanediamine, and mixtures thereof.

15. The grease of claim 12, wherein the cycloalkylamine is selected from the group consisting of cyclohexylamine, cyclopentylamine, cycloheptylamine, and cyclooctylamine.

16. The grease of claim 12, wherein the aryl-containing-diisocyante or alkyldiisocyanate is selected from the group consisting of toluene diisocyanate, hexanediisoycanate, methylene bis(phenylisocyanate), phenylenediisocyanate, bis(diphenylisocyanate), and mixtures thereof.

17. The grease of claim 12, wherein the diureas and polyureas are formed by the reaction of oleylamine, ethylenediamine, cyclohexylamine, and tolune diisocyanate.

18. The grease of claim 12, wherein the lubricant base oil is selected from the group consisting of Group I lubricant base oils, Group II lubricant base oils, Group III lubricant base oils, Group IV lubricant base oils, and mixture thereof.

19. The grease of claim 12, wherein the lubricant base oil is a Fischer Tropsch derived lubricant base oil.

20. The grease of claim 12, wherein the greases comprises the lubricant base oil in an amount of 75 to 99.5 percent by weight and the grease gelling agent in an amount of 0.5 to 25 percent by weight.

21. The grease of claim 12, wherein the grease exhibits a peak average value of less than 15 microns/second.

22. The grease of claim 12, wherein the grease exhibits an anderon value of less than 5.0 micron inches/radian.

23. The grease of claim 12, wherein the grease exhibits a pulse value of less than 350 counts as measured by an anderometer.

24. A grease of claim 12, wherein the grease exhibits a percentage of peaks in BQ2 greater than 50% and a percentage of peaks in BQ3 of greater than 90%.

25. A grease composition comprising:

(a) a lubricant base oil; and (b) a grease gelling agent comprising:

(i) a mixture of diureas of formulas I, II, and III, formula I

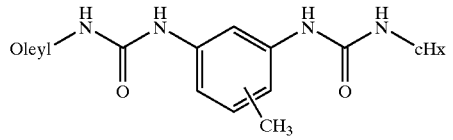

formula II

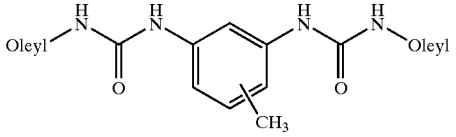

formula III

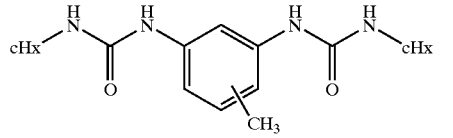

and polyureas of formula IV, formula IV

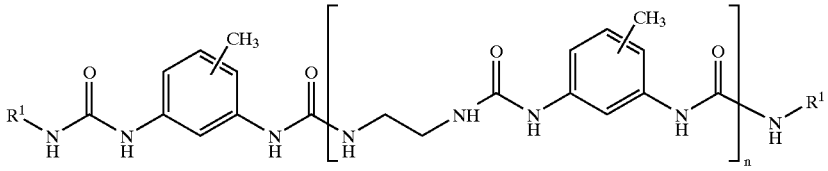

wherein $R^1$ is cHx or Oleyl; and n is an integer from 1 to 10;

wherein the grease gelling agent is comprised of ≧80 weight % of diureas of formulas I, II, and III and 0.1–20 weight % of polyureas of formula IV; and the diureas of formulas I, II, and III are comprised of ≧60 weight % of diurea of formula I, 10–40 weight % of diurea of formula II, and 1–10 weight % of diurea of formula III.

26. The grease of claim 25, wherein the grease gelling agent is comprised of ≧90 weight % of diureas of formulas I, II, and III and 0.1–10 weight % of polyureas of formula IV.

27. The grease of claim 26, wherein the grease gelling agent is comprised of ≧95 weight % of diureas of formulas I, II, and III and 0.1–5 weight % of polyureas of formula IV.

28. The grease of claim 26, wherein the diureas of formulas I, II, and III are comprised of 60–80 weight % of diurea of formula I, 20–30 weight % of diurea of formula II, and 1–5 weight % of diurea of formula III.

29. The grease of claim 27, wherein the diureas of formulas I, II, and III are comprised of 60–80 weight % of diurea of formula I, 20–30 weight % of diurea of formula II, and 1–5 weight % of diurea of formula III.

30. The grease of claim 25, wherein the lubricant base oil is selected from the group consisting of Group I lubricant base oils, Group II lubricant base oils, Group II lubricant base oils, Group IV lubricant base oils, and mixture thereof.

31. The grease of claim 25, wherein the lubricant base oil is a Fischer Tropsch derived lubricant base oil.

32. The grease of claim 25, wherein the greases comprises the lubricant base oil in an amount of 75 to 99.5 percent by weight and the grease gelling agent in an amount of 0.5 to 25 percent by weight.

33. The grease of claim 25, wherein the grease exhibits a peak average value of less than 15 microns/second.

34. The great of claim 25, wherein the grease exhibits a peak average value of less than 10 micros/second.

35. A method for making a grease comprising the steps of:

a) reacting an alkylamine or alkenylamine; an alkylenediamine, polyoxyalkylenediamine, or cycloalkylenediamine; a cycloalkylamine; and an aryl-containing-diisocyante or alkyldiisocyanate in lubricant base oil; and b) recovering the grease.

36. The method of claim 35, wherein the alkylamine or alkenylamine is selected from the group consisting of oleylamine, pentylamine, hexylamine, heptylamine, octylamine, decylamine, dodecylamine, tetradecylamine, hexadecylamine,octadecylamine, docecenylamine, hexadecenylamine, and mixtures thereof.

37. The method of claim 35, wherein the alkylenediamine, polyoxyalkylenediamine, or cycloalkylenediamine is selected from the group consisting of ethylenediamine, propylenediamine, butylenediamine, hexylenediamine, dodecylenediamine, octylenediamine, polyoxypropylenediamine, cyclohexanediamine, and mixtures thereof.

38. The method of claim 35, wherein the cycloalkylamine is selected from the group consisting of cyclohexylamine, cyclopentylamine, cycloheptylamine, and cyclooctylamine.

39. The method of claim 35, wherein the aryl-containing-diisocyante or alkyldiisocyanate is selected from the group consisting of toluene diisocyanate, hexanediisoycanate, methylene bis(pheylisocyanate), phenylenediisocyanate, bis (diphenylisocyanate), and mixtures thereof.

40. The method of claim 35, wherein the diureas and polyureas are formed by the reaction of oleylamine, ethylenediamine, cyclohexylamine, and tolune diisocyanate.

41. The method of claim 35, wherein the lubricant base oil is selected from the group consisting of Group I lubricant base oils, Group II lubricant base oils, Group III lubricant base oils, Group IV lubricant base oils, and mixture thereof.

42. The method of claim 35, wherein the lubricant base oil is a Fischer-Tropsch lubricant base oil.

43. The grease of claim 35, wherein the greases comprises the lubricant base oil in an amount of 75 to 99.5 percent by weight and the grease gelling agent in an amount of 0.5 to 25 percent by weight.

44. The grease of claim 35, wherein the grease exhibits a peak average value of less than 15 microns/second.

* * * * *

UNITED STATES PATENT AND TRADEMARK OFFICE

CERTIFICATE OF CORRECTION

PATENT NO. : 6,916,768 B2
APPLICATION NO. : 10/368484
DATED : July 12, 2005
INVENTOR(S) : Carl E. Ward et al.

It is certified that error appears in the above-identified patent and that said Letters Patent is hereby corrected as shown below:

Column 19, line 19, please delete the word "tolune" and insert --toluene-- in place thereof.

Column 20, line 67, please delete the word "tolune" and insert --toluene-- in place thereof.

Column 21, line 7, please delete the word "greases" and insert --grease-- in place thereof.

Column 21, line 14, please the number "5.0" and insert --6.0-- in place thereof.

Column 22, line 22, please delete the second occurance of "Group II" and insert --Group III-- in place thereof.

Column 22, line 32, please delete the word "great" and insert -- grease -- in place thereof.

Column 22, line 33, please delete the word "micros" and insert --microns-- in place thereof.

Column 23, line 7, please delete the word "(pheylisocyanate)" and insert --(phenylisocyanate)-- in place thereof.

Column 23, line 11, please delete the word "tolune" and insert --toluene-- in place thereof.

UNITED STATES PATENT AND TRADEMARK OFFICE

CERTIFICATE OF CORRECTION

PATENT NO. : 6,916,768 B2
APPLICATION NO. : 10/368484
DATED : July 12, 2005
INVENTOR(S) : Carl E. Ward et al.

It is certified that error appears in the above-identified patent and that said Letters Patent is hereby corrected as shown below:

Column 24, line 6, please delete the word "greases" and insert --grease-- in place thereof.

Signed and Sealed this

Third Day of October, 2006

JON W. DUDAS
*Director of the United States Patent and Trademark Office*